US007393234B1

(12) United States Patent
Chien et al.

(10) Patent No.: US 7,393,234 B1
(45) Date of Patent: Jul. 1, 2008

(54) CONNECTOR WITH LOCKING MECHANISM

(75) Inventors: Ming-Hung Chien, Hunei Township, Kaohsiung County (TW); Alan-C. Lin, Taipei (TW); Tsan-Wei Lin, Bali Township, Taipei County (TW); Way-Han Dai, Linkou Township, Taipei County (TW); Chung-Nan Pao, Wugu Township, Taipei County (TW)

(73) Assignee: Chief Land Electronic Co., Ltd., Taipei County (TW)

( * ) Notice: Subject to any disclaimer, the term of this patent is extended or adjusted under 35 U.S.C. 154(b) by 0 days.

(21) Appl. No.: 12/000,686

(22) Filed: Dec. 17, 2007

(51) Int. Cl.
*H01R 13/64* (2006.01)

(52) U.S. Cl. ..... 439/372; 439/358

(58) Field of Classification Search ..... 439/350, 439/352, 353, 357, 362, 372, 157
See application file for complete search history.

(56) References Cited

U.S. PATENT DOCUMENTS 4,341,428 A * 7/1982 Hatch et al. ..... 439/372
5,154,629 A * 10/1992 Carver et al. ..... 439/352
5,197,900 A * 3/1993 Ellis et al. ..... 439/352
5,213,533 A * 5/1993 Walden ..... 439/372
6,929,500 B2 * 8/2005 Noro ..... 439/358
6,948,973 B1 * 9/2005 Hsu et al. ..... 439/495
7,244,149 B1 * 7/2007 Wang et al. ..... 439/629

* cited by examiner

*Primary Examiner*—Tho D Ta
(74) *Attorney, Agent, or Firm*—Rosenberg, Klein & Lee

(57) ABSTRACT

A connector with a locking mechanism includes an insulating body, a plurality of terminals, a metallic casing and a pair of locking pieces. Both sides of the insulating body are provided with two accommodating troughs. The insulating body is provided with pivot shafts in the two accommodating troughs respectively. The terminals are provided in the insulating body. The metallic casing is provided on the insulating body. The two locking pieces are provided in the two accommodating troughs respectively. Each locking piece is provided with a pivot hole, and the pivot hole is fitted with the pivot shaft of the insulating body. The locking piece is formed with an elastic arm by extending from a wall surface of the pivot hole. The elastic arm abuts against the pivot shaft. Via this arrangement, the locking piece is simple in structure, and can be manufactured easily, thereby reducing production costs.

6 Claims, 5 Drawing Sheets

CONNECTOR WITH LOCKING MECHANISM

BACKGROUND OF THE INVENTION

1. Field of the Invention

The present invention is related to a connector with a locking mechanism, and more particular to a connector that can be connected with cables and can be firmly connected with another corresponding connector via the locking mechanism.

2. Description of Related Art

Signal transmission between various electronic devices can be achieved by using two connectors that are connected to each other. In order to avoid the connector that is connected to another connector from loosening due to an external force so as to deteriorate the connection between these two connectors, usually one of the connectors is provided with a locking mechanism, thereby making the connection more firmly.

The conventional connector with a locking mechanism is provided respectively with a locking piece (FIG. 1) on both sides of an insulating body thereof. The locking piece 10*a* has a base portion 11*a*, an extending portion 12*a* formed by extending from one end of the base portion 11*a*, and a pressing portion 14*a* formed by extending and bending one side of the extending portion 12*a*. The front end of the elastic arm 13*a* is provided with a hook 15*a*. Via the hook 15*a*, the connector can be connected to another corresponding connector more firmly. Further, via the elasticity of the elastic arm 13*a*, a user can press the pressing portion 14*a* to cause the hook 15*a* to remove from the corresponding connector, thereby detaching the connector from the corresponding connector.

However, in the conventional connector with a locking mechanism, the structure of the locking mechanism is complicated and needs to be formed by bending and molding several times. Therefore, it is not easy to manufacture the conventional connector with a locking mechanism, and thus the production cost is high.

Consequently, because of the above technical defects, the inventor keeps on carving unflaggingly through wholehearted experience and research to develop the present invention, which can effectively improve the defects described above.

SUMMARY OF THE INVENTION

The object of the present invention is to provide a connector with a locking mechanism, in which an elastic arm extends from a pivot hole in a locking piece, so that the structure of the locking piece is simpler and can be manufactured more easily. In this way, the production cost can be reduced.

For achieving the object described above, the present invention provides a connector with a locking connector, which includes: an insulating body provided with an accommodating trough on two opposing sides respectively, the insulating body being provided with a pivot shaft in the two accommodating troughs respectively; a plurality of terminals provided in the insulating body; a pair of locking pieces provided in the two accommodating troughs respectively; each locking piece comprising a base portion, a hook formed by extending from one end of the base portion, and a pressing portion formed by extending from another end of the base portion, the base portion being provided with a pivot hole, the pivot hole being fitted with the pivot shaft of the insulating body, the pressing portion extending outside of the insulating body, and the locking piece being formed with an elastic arm by extending from a wall surface of the pivot hole, the elastic arm abutting against the pivot shaft; and a metallic casing provided on the insulating body.

The present invention has advantageous effects as follows. In the locking piece of the present invention, the elastic arm is formed by extending directly from the pivot hole to correspond to the pivot shaft of the insulating body, so that the structure of the locking piece is simpler and can be manufactured more easily. In this way, the whole production cost can be reduced.

In order to further understand the characteristics and technical contents of the present invention, a detailed description is made with reference to the accompanying drawings. However, it should be understood that the drawings are illustrative only but not used to limit the present invention thereto.

DETAILED DESCRIPTION OF THE PREFERRED EMBODIMENTS

Figure 1:
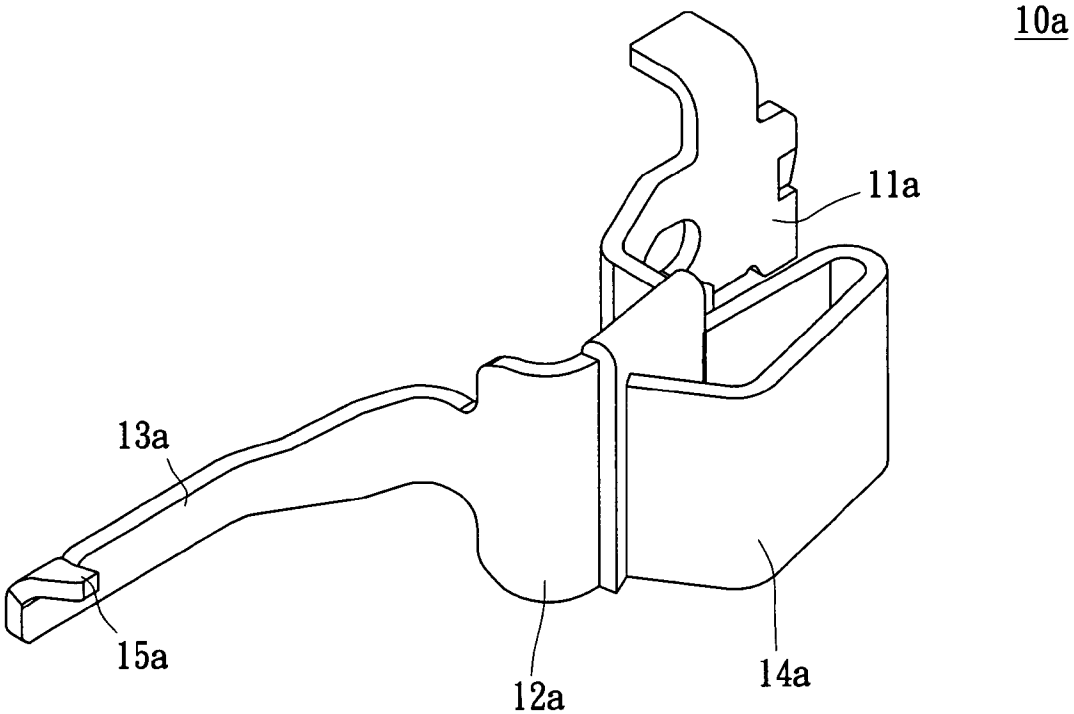
FIG. 1 PRIOR ART
FIG. 1 is a perspective view showing the locking piece of a conventional connector.
Figure 2:
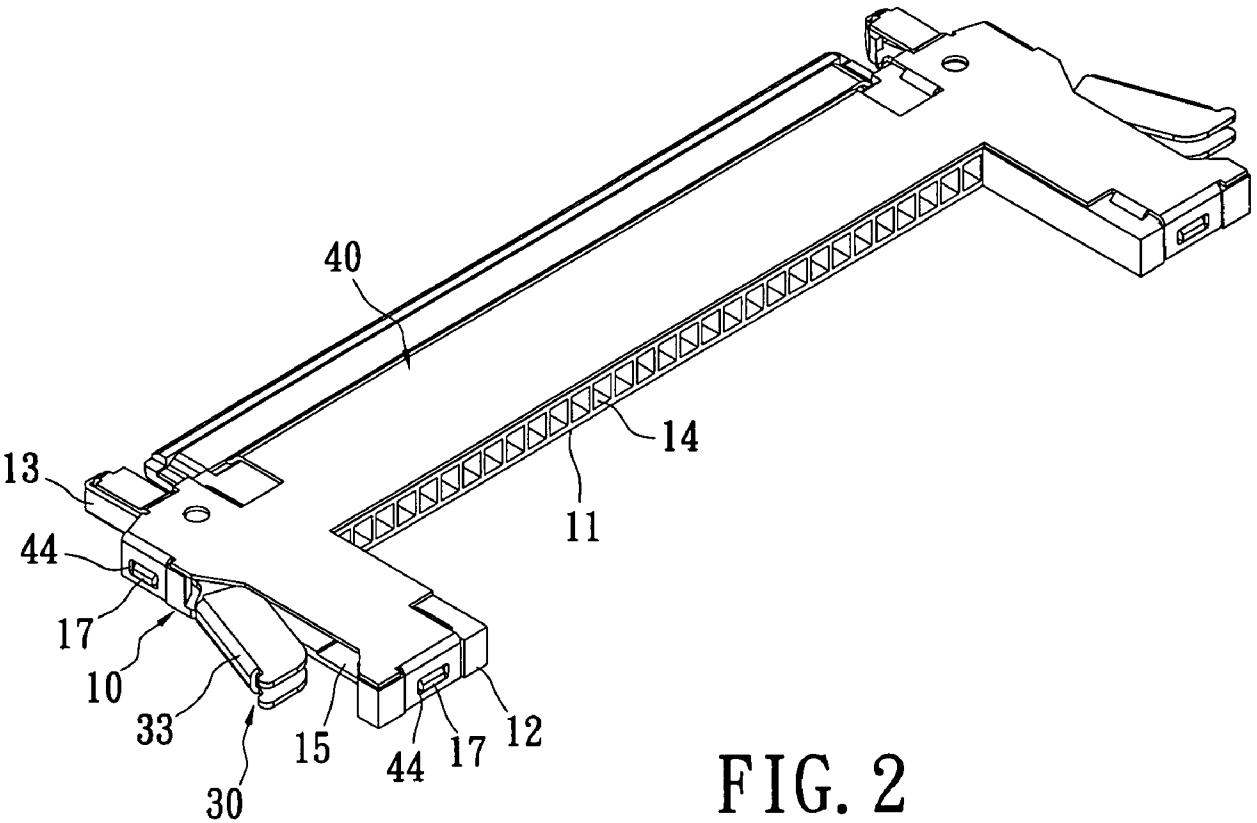
FIG. 2 is an assembled perspective view showing the connector with a locking mechanism of the present invention.

Please refer to FIGS. 2 to 5. The present invention provides a connector with a locking mechanism for connecting to a corresponding connector (not shown). The connector includes an insulating body 10, a plurality of terminals 20, a pair of locking pieces 30 and a metallic casing 40.

The insulating body 10 is made of insulating plastic materials. The insulating body 10 comprises a base portion 11, two side portions 12 and two guiding portions 13. The base portion 11 is provided with a plurality of terminal troughs 14. The terminal troughs 14 penetrate through the rear end surface of the base portion 11.

The two side portions 12 are formed on two opposing sides of the base portion 11 respectively. The two side portions 12 are provided with two accommodating troughs 15 to correspond to the pair of locking pieces 30. The two accommodating troughs 15 penetrate through two side surfaces of the insulating body 10. The insulating body 10 is provided with a pillar-like pivot shaft 16 in the two accommodating troughs 15 respectively. One side of the pivot shaft 16 is recessed radially to form a recess 161. The pivot shaft 16 is formed at the recess 161 with a curved surface 162 and an abutting surface 163 connected with the curved surface 162.

Each of two side portions 12 is provided with a first fixing hole 121 and a second fixing hole 122. The first, second fixing holes 121, 122 penetrate through the top surface and the bottom surface of the two side portions 12. The rear end and one side of the two side portions 12 are provided with a locking body 17 respectively.

The two guiding portions 13 are formed by protruding forwards from a front ends of the two side portions 12. The front ends of the two guiding portions 13 are formed with a guiding slope 131 respectively, thereby guiding the insertion into the corresponding connector. Further, each guiding portion 13 is provided with a trough 132 at one side adjacent to the base portion 11 (refer to FIG. 3). The trough 132 is in communication with the accommodating trough 15. The two guiding portions 13 are provided respectively with a third fixing hole 133 adjacent to the front end thereof. The third fixing hole 133 penetrates through the top surface and the bottom surface of the guiding portion 13.

The terminals 20 are made of metallic materials having electric conductivity. Each terminal 20 has a contacting portion 21 and a soldering portion 22 formed by extending from the contacting portion 21 (also refer to FIG. 3). The contacting portion 21 is electrically connected to terminals preset in the corresponding connector (not shown). The soldering portion 22 is used to connect to a corresponding cable (not shown).

The pair of locking pieces 30 are made by means of pressing metallic materials. Each locking piece 30 comprises a base portion 31, a hook 32 and a pressing portion 33. The hook 32 is formed by extending from one end of the base portion 31. The pressing portion 33 is formed by extending and bending the other end of the base portion 31.

The base portion 31 is provided with a pivot hole 34 for being fitted with the pivot shaft 16 of the insulating body 10. The locking piece 30 is formed with an elastic arm 35 by means of extending from a wall surface of the pivot hole 34. The elastic arm 35 is formed into an arc and extends into the pivot hole 34. The distal end of the elastic arm 35 is a free end and corresponds to the abutting surface 163 of the pivot shaft 16.

Figure 3:
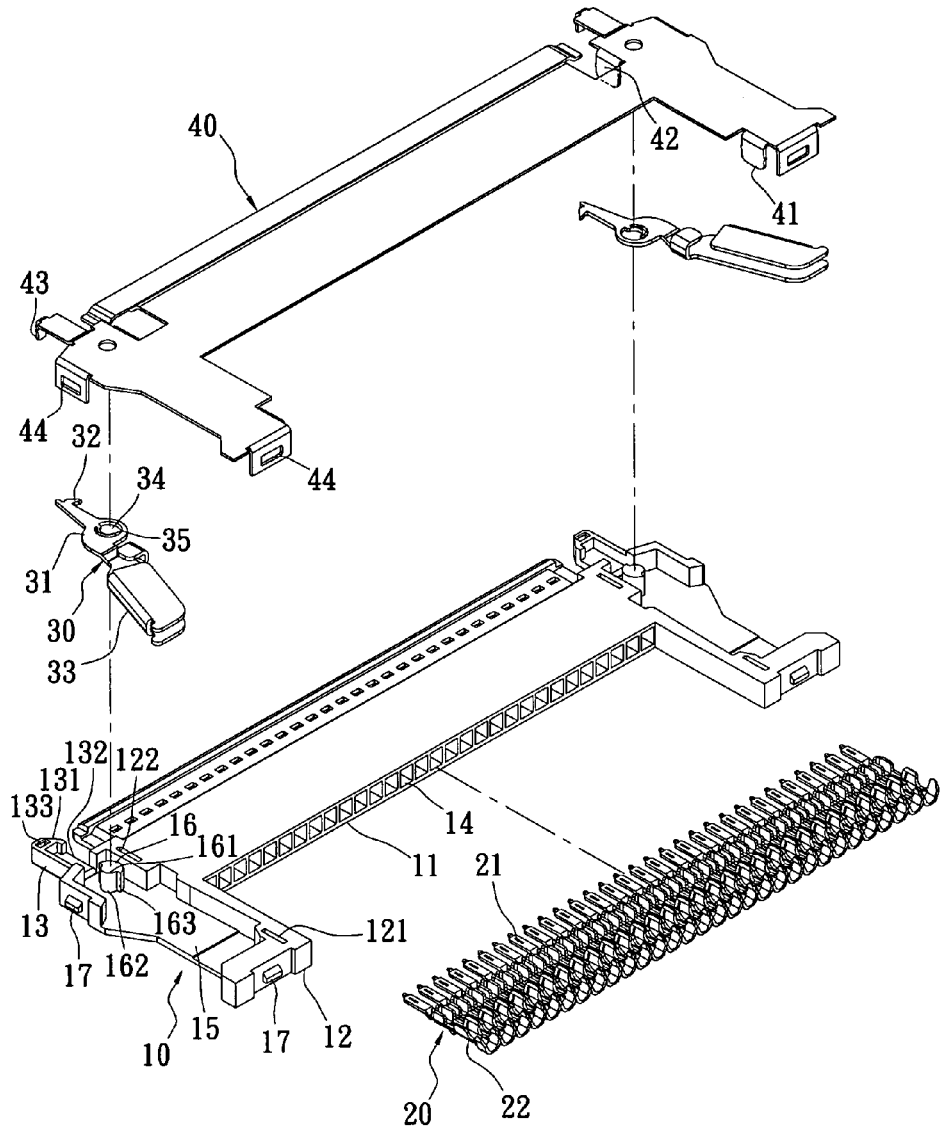
FIG. 3 is an exploded perspective view showing the connector with a locking mechanism of the present invention.
Figure 4:
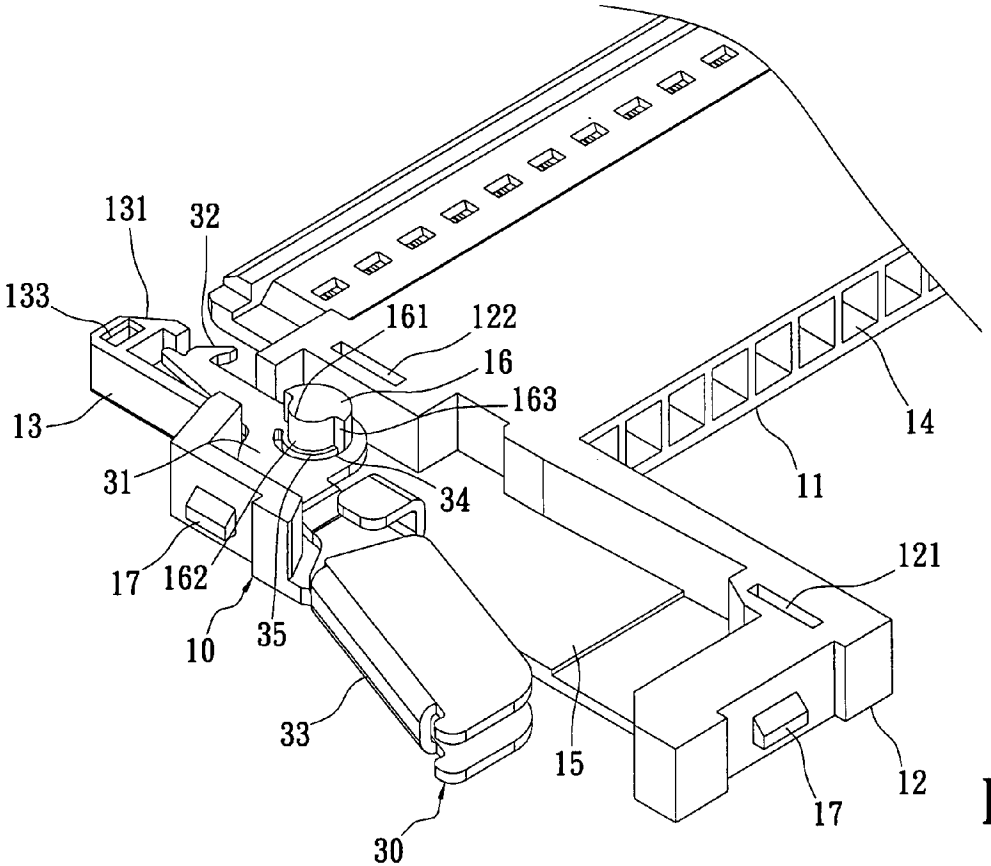
FIG. 4 is an assembled perspective view showing the connector with a locking mechanism of the present invention without showing the metallic casing.
Figure 5:
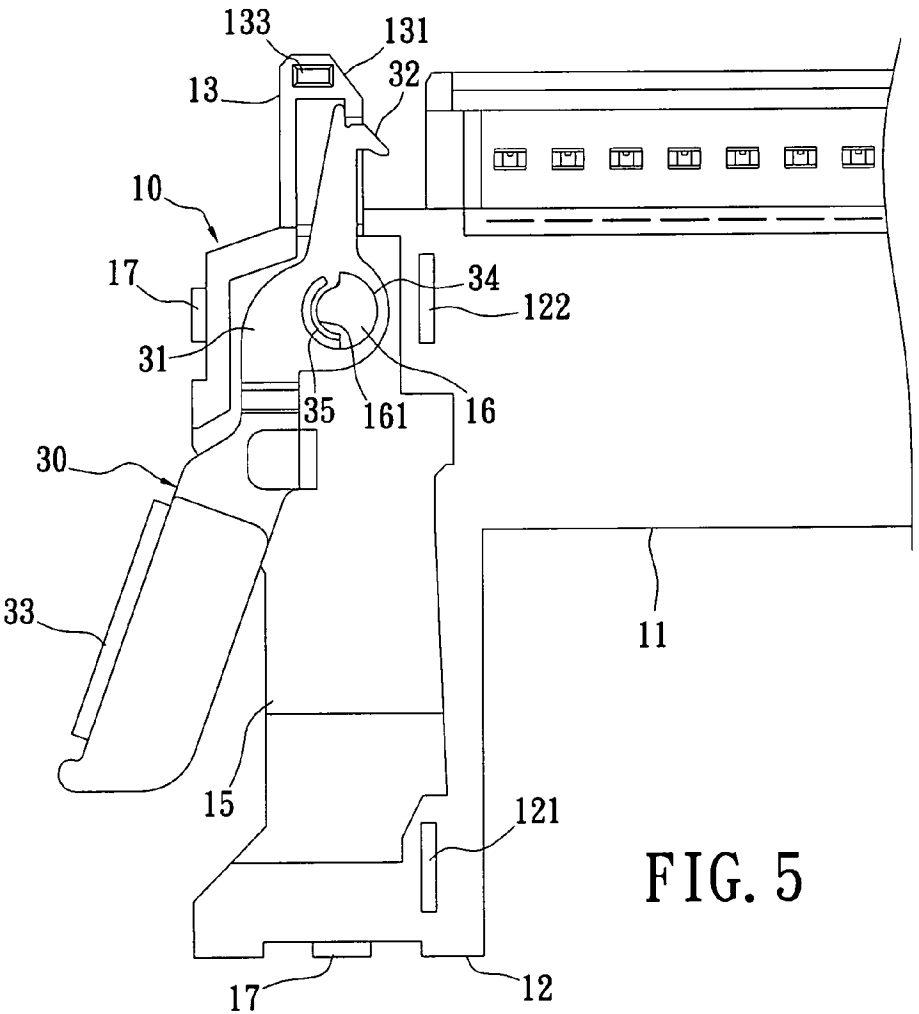
FIG. 5 is a top view showing the connector with a locking mechanism of the present invention without showing the metallic casing.

The metallic casing 40 is made by means of pressing. The metallic casing 40 is formed with two first connecting portions 41, two second connecting portions 42 and two third connecting portions 43 by bending downwardly at proper locations (FIG. 3). The two first, second and third connecting portions 41, 42, 43 correspond to the two first, second and third fixing holes 121, 122, 133 of the insulating body 10 respectively. The metallic casing 40 is provided with two locking holes 44 to correspond to the two locking bodies 17 of the side portion 12.

In assembling the connector of the present invention, the terminals 20 are inserted forwards into the terminal troughs 14 from the rear of the base portion 11 of the insulating body 10.

The two locking pieces 30 are accommodated in the two accommodating troughs 15 respectively, and the hook 32 of the locking piece 30 extends outside the guiding portion 13 via the trough 132. The pressing portion 33 extends outside the side portion 12 of the insulating body 10.

The pivot holes 34 of the two locking pieces 30 are fitted with the two pivot shafts 16 of the insulating body 10 respectively, so that the two locking pieces 30 can use the two pivot shafts 16 as spindles to rotate with respect to the insulating body 10. One side of the elastic arm 35 of the locking piece 30 abuts against the curved surface 162 of the pivot shaft 16 (also refer to FIG. 4), and the end surface of the distal end of the elastic arm 35 abuts against the abutting surface 163 of the pivot shaft 16.

The two first connecting portions 41 and two second connecting portions 42 of the metallic casing 40 are fixed into the first fixing holes 121 and the second fixing holes 122 of the two side portions 12 respectively. The two third connecting portions 43 are fixed into the third fixing holes 133 of the two guiding portions 13 respectively. The locking holes 44 of the metallic casing 40 are locked with the locking bodies 17 of the side portion, so that the metallic casing 40 can be mounted on the insulating body 10.

When the connector is connected with a corresponding connector, the hooks 32 of the locking pieces 30 can be buckled to locking holes (not shown) preset in the corresponding connector, so that the connector can be connected with the corresponding connector firmly, thereby preventing loosening or falling off.

When the connector is to be detached from the corresponding connector, the user can press the pressing portion 33 of the locking piece 30. With the rotation of the two locking pieces 30 with respect to the insulating body 10 and the elastic deformation of the elastic arms 35 abutting against the pivot shafts 16, the two hooks 32 can be detached from the locking holes of the corresponding connector. In this way, the connector can be detached from the corresponding connector.

According to the above, in the connector with a locking mechanism of the present invention, the pivot hole 34 of the locking piece 30 is formed with an elastic arm 35. With the elastic arm 35 being fitted with the pivot shaft 16 of the insulating body 10, the locking piece 30 has a locking effect. The locking piece 30 of the present invention is simple in structure, so that it is not necessary to perform a complicated process to manufacture the locking pieces. Therefore, it is easy to manufacture and assemble the present invention, thereby reducing the whole production cost.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A connector with a locking mechanism, comprising;

an insulating body provided with accommodating troughs on two opposing sides respectively, the insulating body being provided with a pivot shaft in the two accommodating troughs respectively;

a plurality of terminals provided in the insulating body;

a pair of locking pieces provided in the two accommodating troughs respectively, each locking piece comprising a base portion, a hook formed by extending from one end of the base portion, and a pressing portion formed by extending from the other end of the base portion, the base portion being provided with a pivot hole, the pivot hole being fitted with the pivot shaft of the insulating body, the pressing portion extending outside of the insulating body, the locking piece being formed with an elastic arm by extending from a wall surface of the pivot hole, the elastic arm abutting against the pivot shaft; and a metallic casing provided on the insulating body.

2. The connector with a locking mechanism according to claim 1, wherein the two accommodating troughs penetrate two side surfaces of the insulating body respectively.

3. The connector with a locking mechanism according to claim 1, wherein a distal end of the elastic arm is a free end, the pivot shaft is provided with an abutting surface to correspond to the distal end of the elastic arm, and the end surface of the distal end of the elastic arm abuts against the abutting surface of the pivot shaft.

4. The connector with a locking mechanism according to claim 3, wherein one side of the pivot shaft is formed with a recess, the pivot shaft is provided at the recess with the abutting surface and a curved surface connected to the abutting surface, the elastic arm has an arc shape, and one side of the elastic arm abuts against the curved surface of the pivot shaft.

5. The connector with a locking mechanism according to claim 1, wherein the insulating body comprises a base portion and two side portions formed on two opposing sides of the base portion, and the two accommodating troughs are formed by recessing the two side portions.

6. The connector with a locking mechanism according to claim 5, wherein the front end of each of the two side portions is provided with a guiding portion, and the front end of each of the two guiding portions is formed with a guiding slope.

* * * * *